US005152682A

United States Patent [19]

Morozumi et al.

[11] Patent Number: 5,152,682

[45] Date of Patent: Oct. 6, 1992

[54] SCROLL TYPE FLUID MACHINE WITH PASSAGEWAY FOR INNERMOST WORKING CHAMBER

[75] Inventors: Naoya Morozumi, Tokyo; Tsugio Itami, Numazu; Hirotsugu Sakata, Chigasaki; Makoto Hayano, Tokyo; Toshiya Yajima; Masayuki Okuda, both of Yokohama; Teruo Kobuna, Kawasaki, all of Japan

[73] Assignee: Kabushiki Kaisha Toshiba, Kawasaki, Japan

[21] Appl. No.: 677,326

[22] Filed: Mar. 29, 1991

[30] Foreign Application Priority Data

Mar. 29, 1990 [JP] Japan ..... 2-81852
Sep. 28, 1990 [JP] Japan ..... 2-259054

[51] Int. Cl.[5] ..... F01C 1/04; F01C 17/06; F04C 18/04

[52] U.S. Cl. ..... 418/55.1; 418/55.6; 418/151; 418/183

[58] Field of Search ..... 418/55.1, 55.2, 55.3, 418/55.6, 151, 183; 417/366

[56] References Cited

U.S. PATENT DOCUMENTS 4,552,518 11/1985 Utter ..... 418/55.6
5,013,226 5/1991 Nishida ..... 418/151

FOREIGN PATENT DOCUMENTS 57-131896 8/1982 Japan .
63-59032 11/1988 Japan .

*Primary Examiner*—John J. Vrablik
*Attorney, Agent, or Firm*—Cushman, Darby & Cushman

[57] ABSTRACT

A gas compressor comprises a fixed scroll member and a movable scroll member. A plurality of crescent working chambers are defined between the scroll members so that the volume of the working chambers varies when the scroll members are relatively moved. The compressor has a container which seals a power source and the scroll members and forms inner spaces therebetween. An intake port for drawing a gas from the exterior of the container into the working chambers is formed in the outer peripheral region of the fixed scroll member, and an axial port is formed in the inner region of the fixed scroll member so that the working chambers communicates therewith.

12 Claims, 3 Drawing Sheets

SCROLL TYPE FLUID MACHINE WITH PASSAGEWAY FOR INNERMOST WORKING CHAMBER

BACKGROUND OF THE INVENTION

1. Field of the Invention

This invention generally relates to a scroll type fluid machine adapted to be used as a pump for a compressive fluid, a blower, a compressor or the like, and more particularly to a scroll fluid machine suitable for a compressor for compressing a refrigerant used in an air conditioner, a refrigerating apparatus or the like.

2. Description of the Related Art

There has been developed a scroll type fluid machine having a pair of scroll members cooperating with each other and widely used in various fields. In general, each scroll member has an end plate and a spiral scroll wrap or ridge projectingly formed on one surface of the end plate.

The scroll wrap of the scroll members are inserted in spiral grooves defined by the adjacent turns of the spiral wrap of the opposed scroll members so that they are arranged to form crescent chambers defined therebetween. The end faces of the scroll wrap of the scroll members sealingly contact the end plates of the scroll members. As the scroll members are moved relatively, the volumes of crescent working chambers defined between the scroll wraps vary. More specifically, as the scroll members, eccentrically arranged relative to each other, are revolved without rotating about their own axes, each working chamber is moved circumferentially and inwardly, reducing its volume. On the other hand, the reverse revolution of the scroll members without rotating around their own axes causes each working chamber to be moved circumferentially and outwardly, increasing its volume. These two processes provide the compression and expansion of the fluid in each working chamber. The scroll type fluid machine having this structure has the advantages that the variation of the driving torque is small and little fluid leaks from the working chambers.

The Japanese laid-open Patent Application No. 57-131,896 laid open on Aug. 14, 1982 discloses a scroll compressor for compressing refrigerant used in an air conditioner or in a refrigerating apparatus.

The scroll compressor has a container in which are sealingly housed a pair of scroll members and a driving motor disposed thereover in a compact manner. One of the scroll members is fixed to the sealed container and the other one (hereinafter referred to as the "movable scroll member") is provided thereabove, that is, at the side of the driving motor so as to be revolvable abound the axis of the fixed scroll member. A crank shaft extending from and driven by the driving motor is supported by a frame which divides the interior of the container into a driving-motor side chamber and a compressor side chamber, and comprises a crank pin rotatably extending through the movable scroll member and a lower end portion rotatably supported by the fixed scroll member. In the outer periphery of the fixed scroll member is formed an intake port for sucking in a refrigerant gas which port communicates with the beginning portion of a groove defined between the extreme outer portion of the scroll wrap of the fixed scroll member and the inner wall of the fixed scroll member.

When the crank shaft is rotated by the driving motor, the movable scroll member is revolved without rotating around its own axis, together with the crank pin. The refrigerant gas sucked in from the intake port is compressed in each working chamber defined between the movable scroll member and the fixed scroll member as its volume is decreased and arrives at the innermost portion of the groove defined between the adjacent lateral walls of the scroll wrap of the fixed scroll member in the most compressed state. The compressed refrigerant gas is discharged from the upper portion of the container through discharge duct formed in the central portion of the fixed scroll member.

The discharge duct has an axial bore formed in the generally central portion of the end plate of the fixed scroll member and communicating with the innermost working chamber, a radial bore radially extending through the end plate and having one end communicating with the axial hole, and another axial bore extending in the outer peripheral portion of the end plate and communicating with the other end of the radial hole.

In this connection, three machining processes are required to form the complicated discharge duct in the fixed scroll member in this conventional scroll compressor, increasing the manufacturing cost. The end plate of the fixed scroll member must be made thick to form the radial bore therein.

Further, it is necessary that discharge duct formed on the fixed scroll member communicate with a duct formed on the frame so that the compressed refrigerant gas is discharged from the upper portion of the container. Since the frame and the fixed scroll member which sandwich the movable scroll member cannot have large contact areas in view of their structure, a sufficient sealing area for effecting the sealing between both discharge ducts cannot be provided, it is feared that the refrigerant gas under high pressure leaks between the frame and the fixed scroll member toward the intake port.

SUMMARY OF THE INVENTION

The object of this invention is to provide a scroll type fluid machine which has a simple structure and a light weight, which is manufactured at a low cost, and in which little leakage of a compressed gas occurs.

According to this invention, there is provided a fluid machine comprising: a power source; a pair of scroll members each having an inner peripheral region and an outer peripheral region and relatively moved with respect to each other by means of the power source, the scroll members defining therebetween a plurality of crescent working chambers which change their volumes between the inner and outer peripheral regions when the scroll members are moved relatively by means of the power source; a container for sealing the power source and the scroll members and defining together with the scroll members inner spaces therebetween; first communication means formed in the outer peripheral region of one of the scroll members for communicating the outermost working chamber with the exterior of the container; and second communication means extending in the inner region of the other one of the scroll members for communicating the innermost working chamber with one of the inner spaces.

The fluid machine enables the power source and the scroll members to be sealed in the container and is rendered compact.

The outermost working chamber communicates with the exterior of the container by means of the first communication mean formed in the outer peripheral region of one of the scroll members so that fluid is supplied from the exterior of the container thereinto via the first communication means and the innermost working chamber communicates with the inner space of the container by means of the second communication means extending through the inner peripheral region of the other scroll member, whereby the structure of the scroll members is extremely simplified. Further, the arrangement of the first and second communication means in a radially separated state prevents the leakage of the fluid.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles to the invention.

DETAILED DESCRIPTION OF THE PREFERRED EMBODIMENTS

Figure 1:
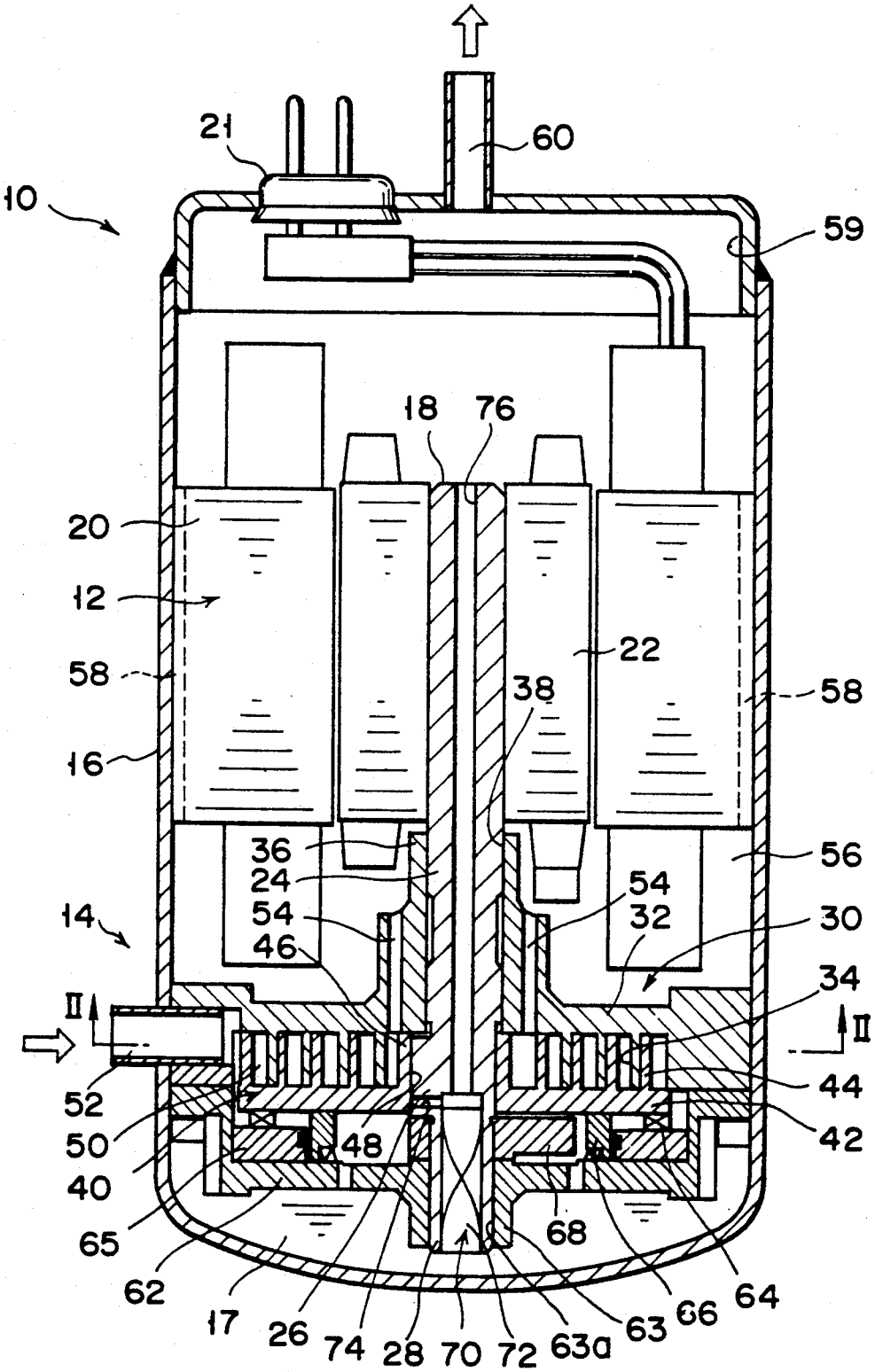
FIG. 1 is a general longitudinal cross-sectional view of an embodiment of the scroll compressor according to this invention.

FIG. 1 shows a scroll type fluid machine in the form of a scroll compressor 10 used for compressing a refrigerant gas in a refrigerating apparatus or an air conditioner.

The scroll compressor 10 comprises an induction motor 12 and a compressing mechanism 14 disposed thereunder under and driven thereby. The induction motor 12 and the compressing mechanism 14 are sealed in a container 16.

The motor 12 comprises a stator 20 fixed to the container 16, a rotor 22 rotatably disposed therein, and a driving shaft 18 extending through the rotor 22 and fixed thereto. The driving shaft 18 has an extension portion extending downward from the level of the lower end of the motor 12 and acts as a crank shaft 24 for driving the compressing mechanism 14. Electric energy is supplied from an external power source to the motor 12 via a terminal box 21.

The compressing mechanism 14 comprises a fixed scroll member 30 and a movable scroll member 40.

The fixed scroll member 30 comprises an end plate 32 the outer periphery of which is fixedly secured to the container 16 by means of fixing means such as bolts (not shown) and a scroll wrap or scroll ridge 34 extending downwardly from the undersurface of the end plate 32. A boss 36 extends upward from the upper surface of the end plate 32, that is, the surface opposite to the undersurface thereof and has a through bore 38 through which the crank shaft 24 rotatably extends. The inner surface of the through bore 38 serves as a bearing surface for rotatably supporting the crank shaft 24.

Movable scroll member 40 comprises an end plate 42, a scroll wrap or scroll ridge 44 extending upright from the upper surface of the end plate 42, and an upright boss 46 formed on the central portion of the end plate 42. The boss 46 has a through hole 48 rotatably receiving the crank pin 26 of the crank shaft 24 so that the through hole 48 serves as a bearing surface of the crank pin 26.

Figure 2:
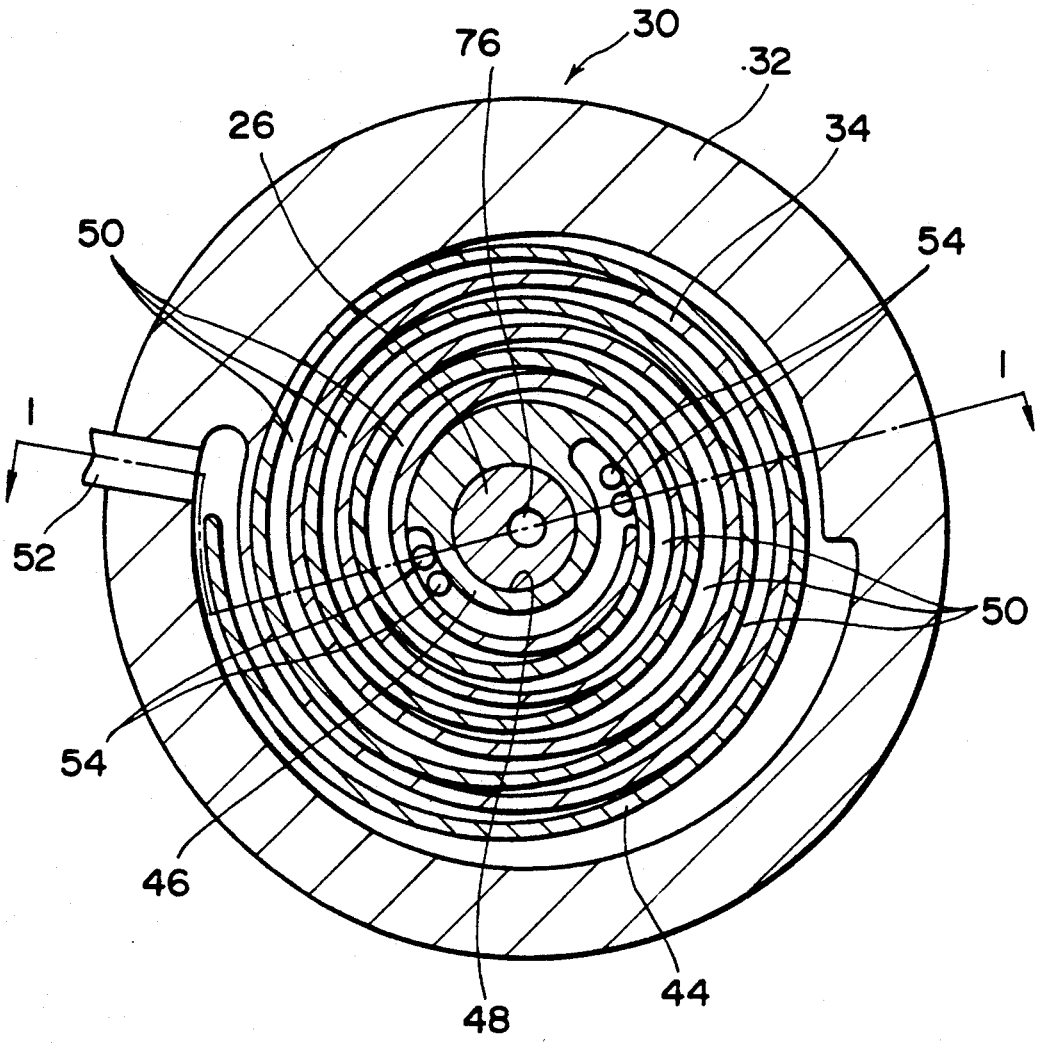
FIG. 2 is a cross-sectional view taken along line II—II of FIG. 1.

As shown in FIG. 2, a spiral groove is defined between the facing lateral walls of the adjacent turns of each of the scroll members 34 and 44. The scroll wrap 34 of the fixed scroll member 30 is inserted in the spiral groove defined between the adjacent turns of the scroll wrap 44 of the movable scroll member 40. The lower end face of scroll wrap 34 contacts the upper surface of the end plate 42 in a sealed and slidable state. Similarly, the scroll wrap 44 of the movable scroll member 40 is disposed in the spiral groove defined between the adjacent turns of the scroll wrap 34 of the fixed scroll member 30 so that the upper end face of the scroll wrap 44 contacts the upper surface of the end plate 32 in a sealed and slidable state. The configuration of the horizontal cross section of each of the lateral walls of the scroll wraps 34 and 44 assumes an arcuate curve such as an involute curve so that crescent working chambers 50 whose upper and lower ends are closed by the undersurface of the end plate 32 and the upper surface of the end plate 42, respectively, are formed between the facing lateral walls of the scroll wraps 34 and 44. The beginning portion of the groove defined between the outer lateral wall of the outermost turn of the scroll wrap 34 and the inner circular wall of the fixed scroll member 30 communicates with an intake port 52 so that a refrigerant gas is supplied therefrom to the groove, and the groove defined by the inner lateral wall of the innermost turn of the scroll wrap 34 and the outer semicircular wall of the central portion of the fixed scroll member 30 communicates with four discharge ports 54. In this embodiment, as shown in FIG. 1, the discharge ports 54 extend axially in the boss 36 of the fixed scroll member 30 and communicate with an outlet pipe 60 through a space 56 formed between the fixed scroll member 30 and the motor 12 and a passageway 58 extending through the stator 20 of the motor 12.

Significantly, the discharge ports 54 are formed only by through holes axially extending through the end plate 32 of the fixed scroll member 30 and the boss 36, and, therefore, it is unnecessary that the thickness of the end plate 32 be rendered larger than that required for its rigidity. This arrangement extremely simplifies the structure of the compressing mechanism 14 and allows the mechanism to be manufactured at a low cost.

Referring back to FIG. 1, the scroll member 40 is supported on the container 16 by means of a turning ring 64 so as to be prevented from rotating around its own axis.

The turning ring 64 is disposed on a supporting member 65 immovably fixed to the frame 62, and provided on or in the upper surface thereof with a pair of straight ridges or grooves intersecting at right angles and in the undersurface thereof a pair of straight ridges or grooves also intersecting at right angels. These pairs of ridges or grooves respectively slidably engage the straight grooves or ridges formed in or on the undersurface of the eccentrically movable scroll member 40 and the upper surface of the supporting member 65. It is understood that the ring 64, the movable scroll member 40 and the supporting member 65 cooperate to be operated as an Oldham's coupling.

The frame member 62 has a central boss 63 formed with a through bore 63*a*. On the frame 62 is fixed a high pressure bearing ring 66 for receiving a thrust load which acts on the movable scroll member 40. The inner wall of the through hole 63*a* rotatably supports a reduced-diameter portion 28 formed on the front end or the lower end of the crank shaft 24. A counterweight 68 is mounted on the reduced-diameter end portion 28.

The reduced-diameter portion 28 has a pump 70 for supplying lubricant to required portions. The pump 70 comprises vanes 72 arranged in a hole in the end portion 28. When the driving shaft 18 and the crank shaft 24 are rotated, the pump 70 sucks in lubricant from a reservoir 17 formed by the lower portion of the container 16 and forces the lubricant. The pressurized lubricant is supplied from the pump 70 to the portions required to be lubricated via a lubricant supplying hole 74. A hole 76 extends through the crank shaft 24 and the driving shaft 18 and opens at the top end of the driving shaft 18 so that the pressure of the lubricant balances with the gas pressure in the container 16.

The operation of the scroll compressor 10 according to the above embodiment will now be explained.

As electric energy is supplied from the external power source to the motor 12, the crank shaft 24 connected to the driving shaft 18 of the motor 12 is rotated.

The fixed scroll member 30 is secured to the container 16 so as not to be rotated. The movable scroll member 40 moves eccentrically around the axis of the driving shaft 18 in such a way that the movable scroll member 40 is prevented, by means of the turning ring 64, from rotating around the axis of the crank pin 26. In this process, the volume of the working chambers 50 defined between the scroll members 30 and 40 becomes smaller and smaller as they approach the central portion of the scroll members 30 and 40 so that the gas sucked in the working chambers 50 from the intake port 52 is more and more compressed as the working chambers 50 approach the central portion of the scroll members 30 and 40 and is finally discharged through the discharge ports 54 in the chamber 56. Further, the compressed gas from the chamber 56 cools the motor 12 when it is conducted through the passageway 58, and thereafter is delivered to the exterior of the container 16 via the outlet port 60. As a result, little compressed gas leaks toward the low pressure side, whereby this scroll compressor 10 has a high comprising efficiency.

The rotation of the motor 12 causes the pump 70 provided on the lower end of the crank shaft 24 to supply lubricant to the required portions. The hole 76 extending through the crank shaft 24 and the driving shaft 18 permits the pump pressure to balance with the gas pressure and allows the lubricant to be prevented from scattering.

It is apparent that the reverse process can be carried out by the reverse rotation of the driving shaft 18.

Another embodiment will be explained with reference to FIG. 3. The same referential numerals are used to indicate the same elements of the first embodiment, the description thereof being omitted.

Figure 3:
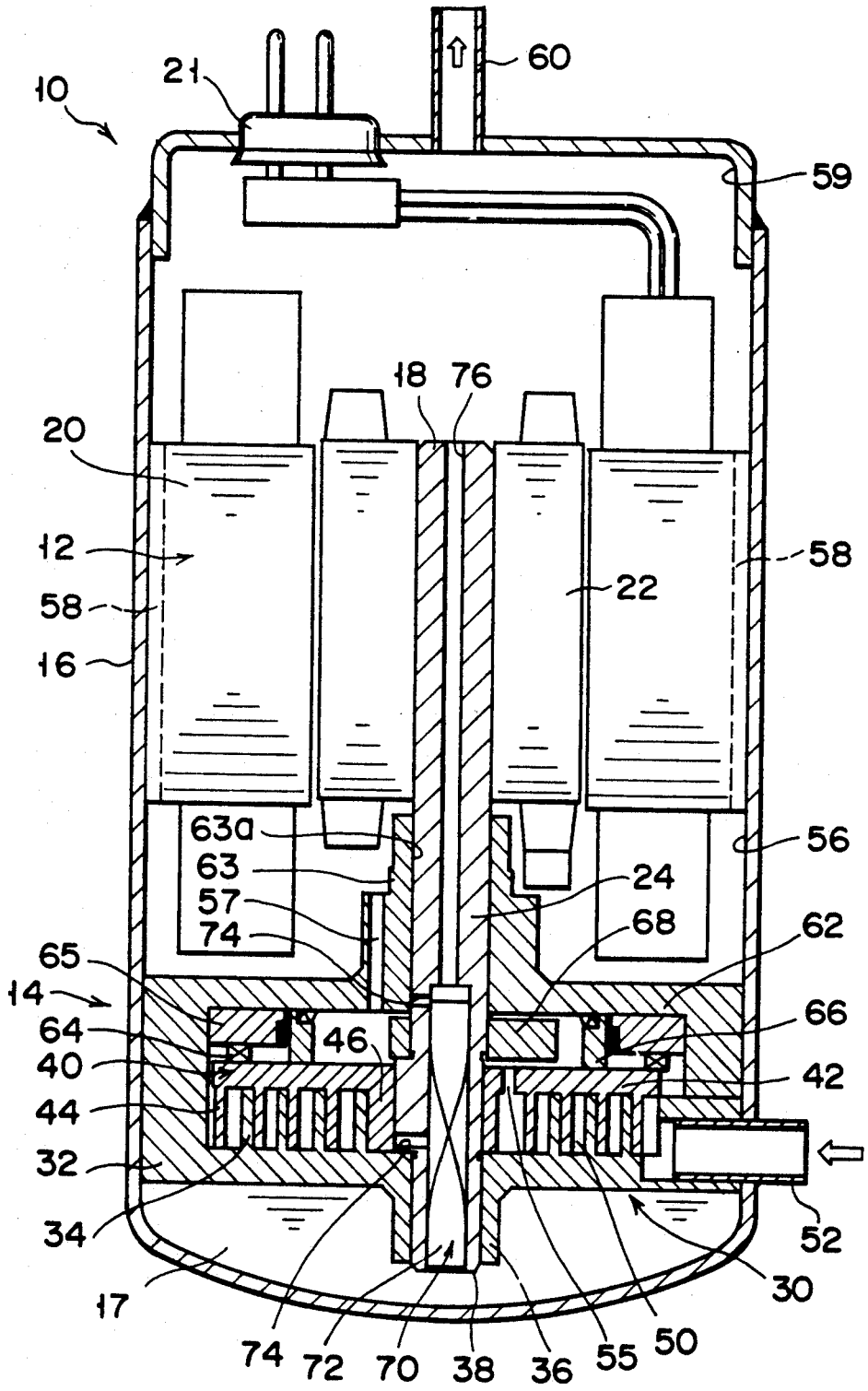
FIG. 3 is a longitudinal cross-sectional view of another embodiment according to this invention.

In FIG. 3, a scroll compressor 10 has a compressing mechanism 14 comprising a fixed scroll member 30 and a movable member 40 which are arranged reversely to those of the first embodiment as shown in FIG. 1.

In the second embodiment, an axial discharge port 55 is formed in the vicinity of the boss 46 of the end plate 42 of the movable scroll member 40, and another axial discharge port 57 is formed in the boss of a frame member 62. Like the discharge ports 54 in FIG. 1, the axial discharge ports 55 and 57 enable compressed gas in the working chambers 50 to be delivered to the chamber 56 in the container 16 without leaking to the intake side of the compressor. Since both the discharge ports 55 and 57 extend axially, they are easily formed without requiring any complicated machining operation. Further, it is unnecessary to make end plate 42 of the eccentrically movable scroll member 40 any thicker than that for providing required rigidity.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept a defined by the appended claims and their equivalents.

What is claimed is:

1. A fluid machine comprising:

a container for sealingly containing a power source and a pair of scroll members and for defining together with said scroll members inner spaces therebetween;

said scroll members including a first scroll member disposed close to said power source and fixed directly to said container, and a second scroll member driven by means of said power source, each of said first and second scroll members having an inner region and an outer peripheral region and defining therebetween a plurality of crescent working chambers which change in volume between said inner region and outer peripheral regions when said second scroll member is driven by means of said power source;

a drive shaft, driven by said power source and axially penetrating said first and second scroll members, for driving said second scroll member, said drive shaft having an end which is protruded from said second scroll member;

a pair of bearing means for rotatably supporting said rank drive shaft;

a frame member fixed within said container at a position in which said frame member and said first scroll member sandwich said second scroll member, and having a boss forming one of said pair of bearing means;

first communication means, formed in said outer peripheral region of said first scroll member, for allowing an outermost working chamber to communicate with an exterior of said container; and second communication means, axially extending in the inner region of said first scroll member, for allowing an innermost working chamber to communicate with one of said inner spaces.

2. The fluid machine according to claim 1, wherein said drive shaft further comprises:

a crank shaft having two ends, and having a crank pin on which said second scroll member is mounted;

a pair of bearing means for rotatably supporting said crank shaft at said two ends; and third communication means for allowing said inner spaces to communicate with the exterior of said container.

3. The fluid machine according to claim 1, which comprises a compressor.

4. The fluid machine according to claim 4, wherein said first scroll member has a boss forming the other end of said pair of bearing means.

5. The fluid machine according to claim 4, wherein said boss of said first scroll member has a through bore.

6. The fluid machine according to claim 4, wherein said second communication means has at least one axial passageway formed in said boss of said first scroll member.

7. The fluid machine according to claim 6, wherein said power source comprises an induction motor disposed over said first and second scroll members and having a diametrically centrally arranged driving shaft unitarily formed on said crank shaft.

8. The fluid machine according to claim 6, wherein said container is provided at a bottom thereof with a lubricant reservoir containing lubricant having a liquid surface, and said axial passageway opens to said space above said liquid surface.

9. A machine according to claim 8, wherein said second communication means comprises at least one axial passageway formed in said inner region of said first scroll member and at least one axial passageway communicating with said axial passageway of said first scroll member.

10. A machine according to claim 9, wherein said container is provided at a bottom thereof with a lubricant reservoir containing lubricant having a liquid surface, and said axial passageway formed in said boss opens to said space above said liquid surface.

11. The fluid machine according to claim 1, wherein said frame member and said second scroll member define an inner chamber therebetween, and said crank shaft has a counterweight housed in said inner chamber.

12. The fluid machine according to claim 11, further comprising prevention means disposed in said inner chamber for preventing said second scroll member from rotating around its own axis.

* * * * *